US006248142B1

(12) United States Patent
Caprotti

(10) Patent No.: US 6,248,142 B1
(45) Date of Patent: Jun. 19, 2001

(54) FUEL COMPOSITION CONTAINING LUBRICITY ADDITIVE

(75) Inventor: Rinaldo Caprotti, Oxford (GB)

(73) Assignee: Exxon Chemical Patents Inc, Linden, NJ (US)

( * ) Notice: Subject to any disclaimer, the term of this patent is extended or adjusted under 35 U.S.C. 154(b) by 0 days.

(21) Appl. No.: 09/284,173

(22) PCT Filed: Sep. 15, 1997

(86) PCT No.: PCT/EP97/05109

§ 371 Date: Aug. 30, 1999

§ 102(e) Date: Aug. 30, 1999

(87) PCT Pub. No.: WO98/16597

PCT Pub. Date: Apr. 23, 1998

(30) Foreign Application Priority Data

Oct. 11, 1996 (GB) ..... 9621231

(51) Int. Cl.[7] ..... C10L 1/18
(52) U.S. Cl. ..... 44/440; 44/450
(58) Field of Search ..... 44/450, 440

(56) References Cited

U.S. PATENT DOCUMENTS

| | | | | |
|---|---|---|---|---|
| 2,499,367 | | 3/1950 | De Groote et al. | 252/342 |
| 2,980,519 | | 4/1961 | Nixon et al. | 44/450 |
| 3,026,297 | * | 3/1962 | Spacht | 44/440 |
| 3,273,981 | | 9/1999 | Furey | 44/385 |
| 3,317,459 | * | 5/1967 | Spacht | 44/450 |
| 3,442,791 | | 5/1969 | Gonzalez | 208/48 |
| 4,054,554 | | 10/1977 | Buriks et al. | 260/59 |
| 4,515,603 | * | 5/1985 | Knepper et al. | 44/440 |

FOREIGN PATENT DOCUMENTS

| | | | |
|---|---|---|---|
| 482253 | | 4/1992 | (EP) . |
| 569228 | | 11/1993 | (EP) . |
| 2531448 | | 2/1984 | (FR) . |
| 2156848 | * | 10/1985 | (GB) . |
| WO 92/07047 | | 4/1992 | (WO) . |
| WO 93/14178 | | 7/1993 | (WO) . |
| WO 94/22988 | | 10/1994 | (WO) . |
| WO 95/33805 | | 12/1995 | (WO) . |

* cited by examiner

*Primary Examiner*—Margaret Medley
*Assistant Examiner*—Cephia D. Toomer

(57) ABSTRACT

Lubricity additives for low sulfur fuels comprising mono- and dialkyl phenols, oligomers thereof and alkoxylated oligomers of alkylene bridged alkyl phenols.

4 Claims, No Drawings

FUEL COMPOSITION CONTAINING LUBRICITY ADDITIVE

This application is a 371 of PCT/EP97/05109, filed Sep. 15, 1997.

This invention relates to hydrocarbon fuel compositions exhibiting improved lubricity characteristics. More particularly this invention relates to low sulfur hydrocarbon fuels whose lubricity is improved through incorporation of certain alkylated phenol additives.

The sulfur content of diesel fuels has now been or will be lowered in a number of countries for environmental reasons, i.e., to reduce sulfur-based components of emissions. Thus, heating oil and diesel fuel sulphur content are being harmonised by the Commission of European Communities at a maximum of 0.2% by weight, and, at a second stage, the maximum content in diesel fuel will be 0.05% by weight. Complete conversion to the 0.05% maximum has been required during 1996.

The process for preparing low sulfur content fuels, in addition to reducing sulfur content, also reduces the content of other components of the fuel such as polyaromatic components and polar components. Reducing one or more of the sulfur, polyaromatic and polar component content of the fuel creates a new problem in use of the fuel, i.e., the ability of the fuel to lubricate the injection system of the engine or combustion equipment is reduced such that, for example, the fuel injection pump of an engine can fail relatively early in the life of the engine, failure being, e.g., in high pressure fuel injection systems such as high pressure rotary distributor pumps, in-line pumps and unit injectors and injectors. Injector pump wear is particularly problematic.

The use of lubricity additives in low sulfur fuels as known in the art. Furey in U.S. Pat. No. 3,273,981, issued Sep. 20, 1966 discloses fuels exhibiting improved lubricity due to the presence of an additive mixture composed of a mixture of a polycarboxylic acid and a partial ester of a polyhydric alcohol, as exemplified by a mixture of sorbitan mono-oleate and $C_{36}$ dimer carboxylic acid.

U.S. Pat. No. 4,054,554, issued Oct. 18, 1971 to Buriks et al. discloses the use of the reaction product of phenol-formaldehyde resins, alpha-olefin epoxides and alkylene oxides as a dehazer for petroleum distillates which contain detergent additives and which exhibit haze since the retention of water is increased due to the presence of the detergent additives in the fuel. This reference does not disclose the presence of these phenol-formaldehyde reaction products in low sulfur fuels. The dehazers are said to be present in amounts of 1–40 ppm, and the preferred additives have 2–30 recurring units of phenolformaldehyde.

In accordance with this invention, there have been discovered hydrocarbon fuel compositions having a sulfur content of less than 0.2% by weight, preferably less than 0.05% by weight, which exhibit improved lubricity through incorporation of 10 to 10,000 ppm of an oil soluble lubricity additive selected from the group consisting of alkylated phenols, including both mono- and di-alkylated phenols, alkylene bridged mono- and di-alkylated oligomeric phenols, alkoxylated mono- and di-alkylated phenols and $C_2$–$C_4$ alkoxylated alkylene bridged oligomeric and cyclic oligomeric alkyl phenols of the general formula

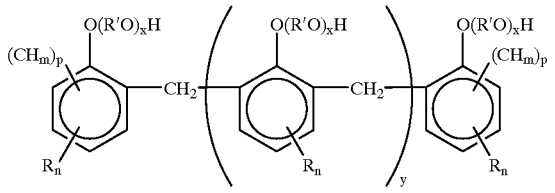

wherein R may be $C_1$–$C_{30}$ alkyl, and each n is independently 1 or 2 and R' is ethylene, propylene or butylene or mixtures thereof, and x is 1–20, preferably 4–6, such as 5, and y is 0–18, preferably 1–2, and wherein m is 2 or 3 and p is 0 or 1. When m is 2, a cyclic oligomeric structure is indicated, the $CH_2$ being linked to another $CH_2$ group, the bridging moiety being —$CH_2CH_2$— for such a cyclic oligomer. In a preferred form, p is 1, m is 2 or 3 and n is 1 or 2.

The $R_n$, $CH_2$ and $CH_m$ substituents may be either at the ortho or para positions on the aromatic ring, relative to the alkoxylated group.

The alkyl phenols may be mono-alkyl or di-alkyl phenols and the alkyl may be a $C_1$ to $C_{30}$ alkyl group. Preferred are mono alkyl phenols having 9 to 24 carbon atoms in the alkyl group, such as para n-octadecyl phenol.

Also preferred are oligomers of monoalkylated phenols where the alkyl has 9 to 24 carbon atoms, such as n-octadecyl, and these may be represented by the formula

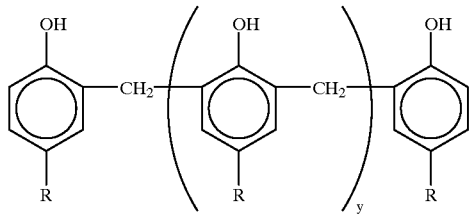

where y is 0–4 and R is $C_9$–$C_{24}$ alkyl, preferably n-octadecyl.

The alkoxylated alkyl phenols may be monoalkylated or dialkylated phenols in the same $C_1$–$C_{30}$ alkyl range and may be adducted with about 1–20 mols of ethylene oxide, propylene oxide or butylene oxide, but ethylene oxide is preferred.

The bridged, alkoxylated oligomeric alkyl phenols are preferably those which have been ethoxylated with about 4–6, especially 5, mols of ethylene oxide per mol and which are bridged monoalkylated phenols wherein the alkyl groups each have 12 to 24 carbon atoms.

The alkylene bridged alkoxylated alkyl phenols may be prepared by processes known in the art. Typically, phenol is heated in the presence of an olefin, such as a propylene $C_{12}$ tetramer, a $C_{24}$ propylene oligomer or a polybutene oligomer having about 12 to 24 carbon atoms using an alkylation catalyst such as Amberlyst 15, an acid treated alkyl phenol ion exchange resin catalyst to form an alkyl phenol.

Bridging occurs as a result of the reaction between the alkylated phenol and, for example, paraformaldehyde in the presence of water and acid catalyst such as sulfuric acid. As a result of this reaction, a bridged oligomeric alkyl phenol is formed as represented below:

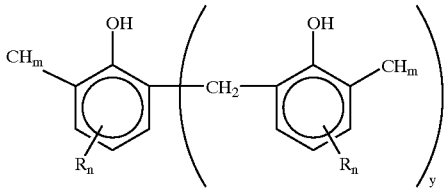

The bridged oligomeric alkyl phenol may then be treated with ethylene oxide, propylene oxide or butylene oxide, or mixtures thereof in the presence of sodium hydroxide to produce the additive useful in this invention. Preferred for use in this invention are the 5 mol ethylene oxide adducts of methylene bridged mono alkyl phenols wherein each alkyl group has 24 carbon atoms and has been prepared by alkylating phenol with a $C_{24}$ propylene oligomer. It has been found that such a 5 mol ethoxylate (per mol of alkyl phenol moiety in the oligomer) as described above is particularly effective as a lubricity agent for low sulfur fuels having a sulfur content of 0.01 wt. % sulfur or less when used at a treat rate of about 200 ppm.

Fuels useful in this invention are those which generally have a sulfur content of 0.05 wt. % or less, such as 0.01 wt. % or less and the sulfur level may be as low as 0.005 wt. % to 0.001 wt. % or even lower. The art describes many ways to reduce the sulfur content of distillate fuels, such as by solvent extraction, sulfuric acid treatment and hydrodesulfurization.

Middle distillate fuel oils to which this invention is particularly applicable generally boil within the range of about 100° C. to about 500° C., e.g. about 150° C. to about 400° C. The fuel oil can comprise atmospheric distillate or vacuum distillate, or cracked gas oil or a blend in any proportion of straight run and thermally and/or catalytically cracked distillates. The most common petroleum distillates are kerosene, jet fuels, diesel fuels, heating oils and heavy fuel oils, diesel fuels being preferred in the practice of the present invention for the above-mentioned reasons. The diesel fuel or heating oil may be a straight atmospheric distillate, or it may contain amounts, e.g. up to 35% by weight of vacuum gas oil or of cracked gas oils or of both.

The concentration of the additive of the invention in the fuel oil may be up to 250,000 ppm, for example up to 10,000 ppm such as 1 to below 1000 ppm (by weight) (active ingredient) preferably 10–500 ppm, such as 10–200 ppm.

Further aspects of the invention include an additive concentrate containing about 10 to 50 wt % of the lubricity additive, the use of the additive or concentrate to improve the lubricity of a fuel having less than 0.2% by weight of sulphur, and a method for improving the lubricity of such a fuel comprising the addition thereto of the additive or concentrate.

The additive may be incorporated into bulk fuel oil by methods known in the art. Conveniently, the additive may be so incorporated in the form of a concentrate comprising an admixture of the additive and a liquid carrier medium compatible with the fuel oil, the additive being dispersed in the liquid medium. Such concentrates preferably contain from 3 to 75 wt. %, more preferably 3 to 60 wt. %, most preferably 10 to 50 wt. % of the additive, preferably in solution in the oil. Examples of carrier liquid are organic solvents including hydrocarbon solvents, for example, petroleum fractions such as naphtha, kerosene and heater oil; aromatic hydrocarbons; paraffinic hydrocarbons such as hexane and pentane; and alkoxyalkanols such as 2-butoxyethanol. The carrier liquid must of course be selected having regard to its compatibility with the additive and with the fuel.

The additives of the invention may be used singly or as mixtures of more than one additive. They may also be used in combination with one or more coadditives such as known in the art, for example, the following: detergents, antioxidants (to avoid fuel degradation), corrosion inhibitors, dehazers, demulsifiers, metal deactivators, antifoaming agents, cetane improvers, cosolvents, package compatibilisers, and middle distillate cold flow improvers.

Fuels

Fuels used in the tests have the following characteristics:

| | |
|---|---|
| Fuel I: | |
| S content | <0.01% (wt/wt) |
| Aromatics content | <1% (wt/wt) |
| Cetane number | 55.2 to 56.1 |
| Cold Filter Plugging Point Temperature (CFPPT) | −36° C. |
| 95% boiling point | 273° C. |
| Low Sulfur ADO Fuel: | |
| Distillation: | IBP 157° C. |
| (ASTM D86) | FBP 345° C. |
| S Content | 0.021% (wt/wt) |
| Cloud Point | −11° C. |
| Density | 0.8256 at 15° C. |

Lubricity of the fuels was measured using the High Frequency Reciprocating Rig (or HFRR) test described in D. Wei and H. Spikes, Wear, Vol. 111, No. 2, p 217, 1986; and R. Caprotti, C. Bovington, W. Fowler and M. Taylor SAE paper 922183; SAE fuels and lubes, meeting October 1992; San Francisco, USA.

The invention is further illustrated by the following examples which are not to be considered as limitative of its scope:

EXAMPLE 1

Fuel I was treated with 200 ppm of the 5 mol ethoxylate of a methylene bridged $C_{24}$ para alkylated phenol oligomer having the formula:

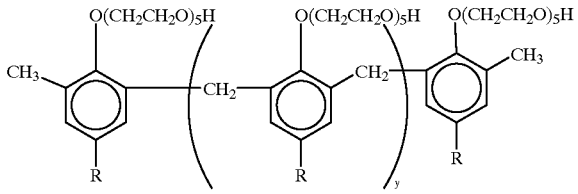

where R is $C_{24}$ alkyl and y is 1–2. Results in the HFRR test at 60° C. showed a wear scar diameter of 280 microns vs. 590 for the untreated fuel and a coefficient of friction of 0.21 vs. 0.72 for the untreated fuel.

EXAMPLE 2

The HFRR test was again carried out at 60° C. using monoalkylated octadecyl phenol at differing treat levels in the Low Sulfur ADO fuel. Results are below:

| Treat Level | Wear Scar in Microns Low S ADO |
|---|---|
| 400 ppm | 534 |
| 1000 ppm | 372 |
| Untreated Fuel | 550 |

EXAMPLE 3

The HFRR test was repeated using the same fuel as Example 2 and a lubricity additive of the formula:

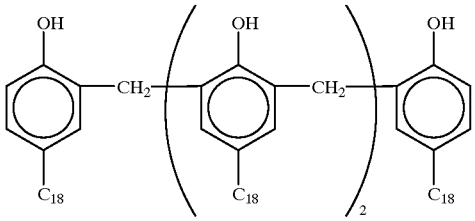

where $C_{18}$ is an n-octadecyl group.

| Treat Level | Wear Scar in Microns |
|---|---|
| 200 ppm | 469 |
| 400 ppm | 329 |
| Untreated Fuel | 550 |

The examples indicate the lubricity-enhancing properties of the alkyl phenolic compounds of the invention.

What is claimed is:

1. A fuel composition comprising a distillate fuel having a sulfur content less than 0.05% by weight and from 1 to 10,000 ppm of a lubricity additive of the formula

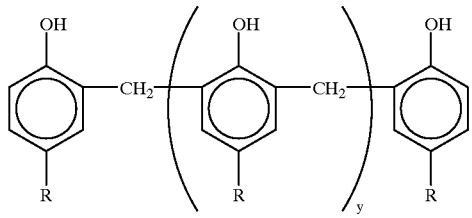

where R is $C_9$–$C_{24}$ alkyl and y is 0–4.

2. The composition of claim 1 wherein y is 2 and R is n-octadecyl.

3. An additive concentrate containing about 3 to 75 wt % of a lubricity additive selected from the group defined in the composition of claim 1.

4. A method for improving the lubricity of a distillate fuel having a sulfur content of less than 0.05% by weight, comprising the addition thereto of the additive defined in the composition of claim 1.

* * * * *